United States Patent [19]

Reinert et al.

[11] Patent Number: 4,831,068

[45] Date of Patent: May 16, 1989

[54] PROCESS FOR IMPROVING THE PHOTOCHEMICAL STABILITY OF DYEINGS ON POLYESTER FIBRE MATERIALS

[75] Inventors: Gerhard Reinert, Allschwil; Kurt Burdeska, Basle, both of Switzerland

[73] Assignee: Ciba-Geigy Corporation, Ardsley, N.Y.

[21] Appl. No.: 156,640

[22] Filed: Feb. 17, 1988

[30] Foreign Application Priority Data

Feb. 27, 1987 [CH] Switzerland ..... 752/87

[51] Int. Cl.[4] ..... C08G 63/46

[52] U.S. Cl. ..... 524/100; 8/442; 8/490; 8/566; 8/190; 525/418; 536/81

[58] Field of Search ..... 524/100; 525/418; 536/81; 8/442, 490, 566, 190

[56] References Cited

U.S. PATENT DOCUMENTS 4,775,386 10/1988 Reinert et al. ..... 8/442

FOREIGN PATENT DOCUMENTS 1379138 10/1964 France .
1011575 12/1965 United Kingdom .

OTHER PUBLICATIONS

Chem. Abstract 81, 79302d, 1974.

*Primary Examiner*—Maurice J. Welsh
*Attorney, Agent, or Firm*—Edward McC. Roberts

[57] ABSTRACT

A process is described for improving the photochemical stability of dyeings on polyester fibre materials by means of UV absorbers of the formula

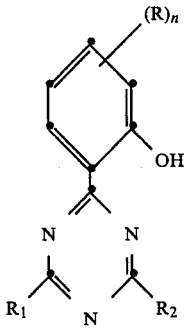

(1)

in which R is lower alkyl, lower alkoxy, halogen or hydroxyl, $R_1$ and $R_2$ independently of one another alkyl which is substituted by hydroxyl, lower alkoxy, lower alkylthio, amino, monoalkylamino or dialkylamino, phenyl, phenyl which is substituted by chlorine, lower alkyl or lower alkoxy, or o-hydroxyphenyl, and n is 0, 1 or 2.

6 Claims, No Drawings

PROCESS FOR IMPROVING THE PHOTOCHEMICAL STABILITY OF DYEINGS ON POLYESTER FIBRE MATERIALS

The present invention relates to a process for improving the photo-chemical stability of dyeings on polyester fibre materials.

Dyed polyester fibre material is damaged when exposed to light, particularly when subjected to heat at the same time. Such dyed materials have, therefore, been protected against the effects of light and heat by means of UV absorbers of the benzophenone or benzotriazole type, but without achieving satisfactory results, because, owing to their inadequate fastness to sublimation, these compounds have resulted in loss of product and hence inadequate protection, when the dyeings are thermofixed and when they are exposed to light at elevated temperatures.

The photochemical stabilization of organic materials, for example, completely synthetic polymers and natural polymers, in particular pure addition polymers and pure condensation polymers or condensation polymers crosslinked by addition polymerization, for example polyester resins, is known from US-A 3,896,125. This relates, however, to the protection of these organic materials by incorporating the protecting agents into the organic polymeric material, o-hydroxyphenyl-s-triazines being employed.

The object on which the present invention is based was to find a process for improving the photochemical stability of dyeings on polyester fibre materials which does not exhibit loss of product and which satisfies the present requirements.

This object is achieved by applying the protecting substances to the fibre materials instead of incorporating them into these materials.

The present invention therefore relates to a process for improving the photochemical stability of dyeings on polyester fibre materials by means of UV absorbers, which comprises treating the fibre material with a compound of the formula

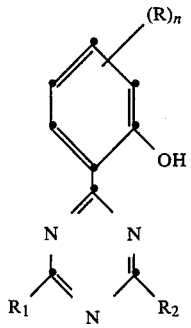

(1)

in which R is lower alkyl, lower alkoxy, halogen or hydroxyl, $R_1$ and $R_2$ independently of one another are alkyl, alkyl which is substituted by hydroxyl, lower alkoxy, lower alkylthiol, amio, monoalkylamino or dialkylamino, phenyl, phenyl which is substituted by chlorine, lower alkyl or lower alkoxy, or o-hydroxyphenyl, and n is 0, 1 or 2.

Suitable lower alkyl, alkoxy or alkylthio radicals are radicals having 1 to 4 C atoms, such as methyl, ethyl, propyl, isopropyl, butyl, isobutyl, sec-butyl, tert-butyl, methoxy, ethoxy, propoxy, isopropoxy, butoxy, isobutoxy, sec-butoxy, tert-butoxy, methylthio, ethylthio, propylthio, isopropylthio, butylthio, isobutylthio, sec-butylthio and tert-butylthio.

Alkyl $R_1$ and/or $R_2$ can be an alkyl radical having 1 to 18 C atoms, such as methyl, ethyl, propyl, isopropyl, n-butyl, tert-butyl, pentyl, hexyl, octyl, decyl, dodecyl, tetradecyl, hexadecyl and octadecyl. Alkyl radicals having 1 to 4 C atoms are preferred. If one of these alkyl radicals is substituted by a monoalkylamino or dialkylamino radical, these are amino radicals which are monosubstituted or disubstituted by lower alkyl, such as methylamino, ethylamino, propylamino, butylamino, dimethylamino, diethylamino, dipropylamino or dibutylamino radicals.

Compounds which are of particular interest for the process according to the invention are those of the formula

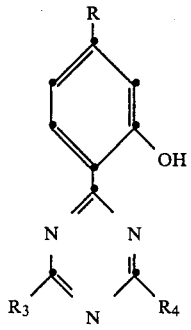

(2)

in which R is as defined above and $R_3$ and $R_4$ independently of one another are alkyl having 1 to 4 C atoms, phenyl or phenyl which is substituted by lower alkyl or lower alkoxy.

In the process according to the invention it is preferable to use compounds of the formula

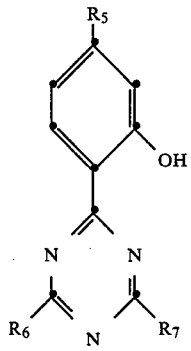

(3)

in which $R_5$ is lower alkyl or lower alkoxy and $R_6$ and $R_7$ independently of one another are alkyl having 1 to 4 C atoms or phenyl.

The compounds of the formulae (1) to (3), which are also known as UV absorbers, are known or can be prepared in a manner known per se, for example by heating an amidine and an o-hydroxybenzenecarboxylic acid ester, preferably in an approximately molar ratio of 2:1, in boiling organic solvents [cf. US 3,896,125 and Helv. Chim. Acta. 55, 1566–1595 (1972)].

The following are examples of suitable compounds of the formulae (1), (2) and (3): 2-(2'-hydroxy-5'-methylphenyl)-4,6-dimethyl-s-triazine: melting point 131° C.; 2-(2'-hydroxy-3',5'-dimethylphenyl)-4,6-dimethyl-s-triazine: melting point 177° C.; 2-(2'-hydroxy-4',5'-dimethylphenyl)-4,6-dimethyl-s-triazine: λ349 μm: T 48%; 2-(2'-hydroxy-4',5'-dimethylphenyl)-4,6-diethyl-s-triazine: melting point 98° C.; 2-(2'-hydroxy-5'-chlorophenyl)-4,6-dimethyl-s-triazine: melting point 160° C.; 2-(2'-hydroxyphenyl)-4,6-dimethyl-s-triazine: melting point 133° C.; 2-(2'-hydroxy-5'-tert-butylphenyl)-4,6-dimethyl-s-triazine: λ352 μm: T 60%; 2-(2'-hydroxyphenyl)-4,6-didecyl-s-triazine: melting point 53° C.; 2-(2'-hydroxyphenyl)-4,6-dinonyl-s-triazine: melting point 45° C.; 2-(2'-hydroxyphenyl)-4,6-diheptadecyl-s-triazine: λ338 μm: T 80%; 2-(2'-hydroxyphenyl)-4,6-dipropyl-s-triazine: melting point 18° to 20° C.; 2-(2'-hydroxyphenyl)-4,6-bis-β-methylmercaptoethyl-s-triazine: λ341 μm: T 60%; 2-(2'-hydroxyphenyl)-4,6-bis-β-dimethyl-aminoethyl-s-triazine: λ340 μm: T 63%; 2-(2'-hydroxyphenyl)-4,6-bis-(β-butylaminoethyl)-s-triazine: λ341 μm: T 66%; 2-(2'-hydroxyphenyl)-4,6-di-tert-butyl-s-triazine: λ338 μm: T 68%; 2-(2'-hydroxyphenyl)-4,6-dioctyl-s-triazine: melting point 40° C.; 2-(2'-hydroxy-4'-methoxyphenyl)-4,6-diphenyl-s-triazine: melting point 204°–205° C.; 2-(2'-hydroxy-4'-ethoxyphenyl)-4,6-diphenyl-s-triazine: melting point 201°–202° C. and 2-(2'-hydroxy-4'-isopropyl)-4,6-diphenyl-s-triazine: melting point 181°–182° C.

The compounds of the formulae (1), (2) and (3) which are to be used as UV absorbers are employed in an amount of 0.05 to 7.5, preferably 0.20 to 3 and especially 0.5 to 2% of the weight of the fibre material.

Examples of polyester fibre material which can be dyed in the presence of the UV absorbers mentioned are cellulose ester fibres, such as cellulose 2½ acetate fibres and triacetate fibres and especially linear polyester fibres. Linear polyester fibres are to be understood in this regard as meaning synthetic fibres which are obtained, for example, by subjecting terephthalic acid to a condensation with ethylene glycol, or isophthalic acid or terephthalic acid to a condensation with 1,4-bis-(hydroxymethyl)-cyclohexane, and also copolymers formed from terephthalic and isophthalic acid and ethylene glycol. The linear polyester hitherto employed almost exclusively in the textile industry consists of terephthalic acid and ethylene glycol.

The fibre materials can also be used as fabrics mixed with one another or with other fibres, for example mixtures of polyacrylonitrile/polyester, polyamide/polyester, polyester/cotton, polyester/viscose and polyester/-wool.

The textile material to be dyed can be various types of material. Piece-goods, such as knitted or woven fabrics, are preferentially suitable.

The disperse dyes to be used, which are only very slightly soluble in water and are present in the dye liquor for the most part in the form of a fine dispersion, can belong to a very wide variety of classes of dyes, for example the acridone, azo, anthraquinone, coumarin, methine, perinone, naphthoquinone imine, quinophthalone, styryl or nitro dyes. It is also possible to employ mixtures of disperse dyes in accordance with the invention.

Polyester/wool mixed fibre materials are preferably dyed in accordance with the invention using commercially available mixtures of anionic dyes and disperse dyes. Examples of the anionic dyes are salts of monoazo, disazo or polyazo dyes, including the formazan dyes, containing heavy metals or, preferably, free from metals, and also of the anthraquinone, xanthene, nitro, triphenylmethane, naphthoquinone imine and phthalocyanine dyes. The anionic character of these dyes can be caused merely by metal complex formation and/or, preferably, by acid, salt-forming substituents, such as carboxylic acid groups, sulfuric acid and phosphonic acid ester groups, phosphonic acid groups or sulfonic acid groups. The molecule of these dyes can also contain so-called reactive groupings which form a covalent bond with the wool.

The 1:1 or 1:2 metal complex dyes are of particular interest. The 1:1 metal complex dyes preferably contain one or two sulfonic acid groups. They contain, as the metal, a heavy metal atom, for example copper, nickel or especially chromium.

The 1:2 metal complex dyes contain, as the central atom, a heavy metal atom, for example a cobalt atom or especially a chromium atom. Attached to the central atom are two complex-forming components, at least one of which is a dye molecule, but preferably both are dye molecules. The two dye molecules participating in the formation of the complex can be identical with, or different from, one another. The 1:2 metal complex dyes can contain, for example, two azomethine molecules, a disazo dye and a monoazo dye or, preferably, two monoazo dye molecules. The azo dye molecules can contain groups imparting solubility in water, for example acid amide or alkylsulfonyl groups or the above-mentioned acid groups. The 1:2 cobalt or 1:2 chromium complexes of monoazo dyes containing acid amide or alkylsulfonyl groups or, in all, a single sulfonic acid group are preferred.

It is also possible to employ mixtures of the anionic dyes.

Fibre mixtures composed of polyester and cotton are dyed as a rule with a combination of disperse dyes and vat dyes, sulfur dyes, leuco vat ester dyes, direct dyes or reactive dyes, the polyester component being dyed with disperse dyes previously, at the same time or subsequently.

The vat dyes are fairly highly fused and heterocyclic benzoquinones or naphthoquinones, sulfur dyes and, in particular, anthraquinoid or indigoid dyes. Examples of vat dyes which can be used in accordance with the invention are listed in the Colour Index, 3rd edition (1971), vol. 3, on pages 3649 to 3837 under the heading "Sulphur Dyes" and "Vat Dyes".

Examples of suitable direct dyes are the "Direct Dyes" listed in the Colour Index, 3rd edition (1971), vol. 2, on pages 2005 to 2478. The leuco vat ester dyes can be obtained, for example, from vat dyes of the indigo, anthraquinone or indanthrene series by reduction, for example by means of iron powder, and subsequent esterification, for example by means of chlorosulfonic acid, and are designated "Solubilised Vat Dyes" in the Colour Index, 3rd edition (1971), vol. 3.

Reactive dyes are to be understood as meaning the customary dyes which form a chemical bond with the cellulose, for example the "Reactive Dyes" listed in the Colour Index, 3rd edition (1971), vol. 3, on pages 3391 to 3560.

The amount of the dyes to be added to the liquor depends on the depth of colourdesired; in general, amounts of 0.01 to 10, preferably 0.02 to 5, percent by weight, relative to the textile material employed, have proved suitable.

The compounds to be used in accordance with the invention can also be employed as a mixture with known carriers based on, for example, dichlorobenzene, trichlorobenzene, methylbenzene, ethylbenzene, o-phenylphenol, benzylphenol, diphenyl ether, chlorobiphenyl, methylbiphenyl, cyclohexanone, acetophenone, an alkylphenoxyethanol, mono-, di or tri-chlorophenoxyethanol, mono-, di- or trichlorophenoxypropanol, pentachlorophenoxyethanol or alkylphenyl benzoates, or, in particular, based on biphenyl, methyldiphenyl ether, dibenzyl ether, methyl benzoate, butyl benzoate and phenyl benzoate.

The carriers are preferably employed in an amount of 0.5 to 2 g/l of liquor or 5 to 10 percent by weight, relative to the compounds to be used.

Depending on the textile material to be treated, the dyebaths can contain, in addition to the dyes and the compounds to be employed in accordance with the invention, wool protection agents, oligomer inhibitors, oxidizing agents, anti-foam agents, emulsifiers, levelling agents, retarders and, preferably, dispersants.

The dispersants are used, in particular, to achieve a good dispersion of the disperse dyes. Dispersants which are generally customary are suitable when dyeing with disperse dyes.

Suitable dispersants are preferably sulfated or phosphated adducts of 15 to 100 moles of ethylene oxide or, preferably, propylene oxide onto polyhydric aliphatic alcohols containing 2 to 6 carbon atoms, for example ethylene glycol, glycerol or pentaerythritol, or onto amines which have 2 to 9 carbon atoms and contain at least two amino groups or one amino group and one hydroxyl group and also alkylsulfonates having 10 to 20 carbon atoms in the alkyl chain, alkylbenzenesulfonates with a linear or branched alkyl chain having 8 to 20 carbon atoms in the alkyl chain, for example nonylbenzenesulfonate, dodecylbenzenesulfonate, 1,3,5,7-tetramethyloctylbenzenesulfonate or octadecylbenzenesulfonate, and also alkylnaphthalenesulfonates or sulfosuccinic acid esters, such as sodium dioctylsulfosuccinate.

Anionic dispersants which have proved particularly advantageous are ligninsulfonates, polyphosphates and, preferably, formaldehyde condensation products formed from aromatic sulfonic acids, formaldehyde and monofunctional or bifunctional phenols, for example from cresol, β-naphtholsulfonic acid and formaldehyde, from benzenesulfonic acid, formaldehyde and naphthalenic acid, from naphthalenesulfonic acid and formaldehyde or from naphthalenesulfonic acid, dihydroxydiphenylsulfone and formaldehyde. The disodium salt of di-(6-sulfonaphth-2-yl)-methane is preferred.

It is also possible to employ mixtures of anionic dispersants. The anionic dispersants are normally in the form of their alkali metal salts, ammonium salts or amine salts. These dispersants are preferably used in an amount of 0.1 to 5 g/l of liquor.

Depending on the dye and substrate to be used, the dyebaths can also contain, in addition to the assistants already mentioned, customary additives, advantageously electrolytes, such as salts, for example sodium sulfate, ammonium sulfate, sodium phosphates or polyphosphates, ammonium phosphates or polyphosphates, metal chlorides or nitrates, such as sodium chloride, calcium chloride, magnesium chloride or calcium nitrates, ammonium acetate or sodium acetate, and/or acids, for example mineral acids, such as sulfuric acid or phosphoric acid, or organic acids, advantageously lower aliphatic carboxylic acids, such as formic, acetic or oxalic acid, and also alkalis or alkali donors or complex-formers.

The acids are used, in particular, to adjust the pH of the liquors used in accordance with the invention, which is, as a rule, 4 to 6.5, preferably 4.5 to 6.

Dyeing is advantageously carried out from an aqueous liquor by the exhaustion process. Accordingly, the dye liquor can be selected within a wide range, for example 1:4 to 1:100, preferably 1:6 to 1:50. The temperature at which dyeing is carried out is at least 50° C. and, as a rule, is not higher than 140° C. It is preferably within the range from 80° to 135° C.

Linear polyester fibres and cellulose triacetate fibres are preferably dyed by the so-called high-temperature process in closed machines, advantageously also pressure-resistant machines, at temperatures above 100° C., preferably between 110° and 135° C., and, if appropriate, under pressure. Examples of suitable closed vessels are circulation machines, such as cheese or beam dyeing machines, winches, spin-dyeing or drum dyeing machines, muff dyeing machines, paddles or jigs.

Cellulose 2½-acetate fibres are preferably dyed at temperatures of 80°-85° C.

The dyeing process according to the invention can be carried out either by first treating the material to be dyed briefly with the compounds and then dyeing it or, preferably, by treating it simultaneously with the compounds and the dye.

The material to be dyed is preferably worked for 5 minutes at 50° to 80° C. in the bath which contains the dye, the compound and, if appropriate, further additives and which is adjusted to a pH value of 4.5 to 5.5, the temperature is raised to 100° to 110° C. in the course of 10 to 20 minutes and to 125° to 130° C. in the course of a further 10 to 20 minutes, and the dye liquor is kept at this temperature for 15 to 90 minutes, preferably 30 minutes.

The dyeings are finished by cooling the dye liquor to 50° to 80° C., rinsing the dyeings with water and, if necessary, cleansing in a customary manner in alkaline medium under reductive conditions. The dyeings are then rinsed again and dried. In the event that carriers are used, the dyeings are advantageously subjected to a heat treatment, for example to thermosol treatment, in order to improve their fastness to light, this treatment being preferably carried out at 160° to 180° C. and for 30 to 90 seconds. If vat dyes are used for the cellulose component, the goods are first treated in a customary manner with hydrosulfite at a pH of 6 to 12.5 and are then treated with an oxidizing agent and are finally washed.

Polyester fibre materials are stabilized photochemically by the process according to the invention, i.e. they are protected against exposure, in particular exposure under hot conditions, to visible and UV light.

One particularly outstanding advantage of the process according to the invention is that, compared with hitherto known processes for the photo-chemical stabilization of polyester fibre materials, no pre-treatment or after-treatment of the fibre material is required.

In the following instructions for preparation and examples, the percentages are by weight, unless otherwise specified. The amounts relate, in the case of the dyes and the UV absorbers, to the pure substance. Any five-figure Colour Index numbers (C.I.) relate to the 3rd edition of the Colour Index.

EXAMPLE 1

5 g of the condensation product formed from naphthalenesulfonic acid and formaldehyde, as a dispersant, dissolved in 7.5 ml of water, and 20 g of quartz microspheres (diameter approx. 1 mm) are added to 5 g of a UV absorber, and the mixture is ground with a stirrer at approx. 1600 revolutions per minute until the particle size is less than 2 μm. The dispersion is separated from the quartz microspheres by means of a fine mesh sieve and is adjusted to a 20% content of active substance with water. 0.3% of carboxymethylcellulose are then stirred in, in order to stabilize the dispersion.

EXAMPLE 2

6 different UV absorbers (UVA) are tested in a comparative manner. This is effected by preparing 39 10 g sample pieces of Diolen® tricot, 3 samples always being dyed together per treatment. 2 different concentrations are made up per UVA, and 3 samples are dyed without UVA. The dyeings are prepared in a customary manner in bombs in an HT machine. The liquors have the following fundamental composition:

2 g/l of ammonium sulfate, 0.5 g/l of a dispersant, 0.2% of C.I. Disperse Orange 53.

[The pH of the liquors is in each case adjusted to 5 with formic acid; the dye is calculated on the weight of the goods.]

For 3 pieces of tricot this liquor contains no further additives; 1.65 and 5.0% of UVA I-VI (in each case ground to 20% content) are also added to all the other liquors.

UVA I: 2-(2'-Hydroxy-3'-tert-butyl-5'-methylphenyl)-5-chlorobenzotriazole.

UVA II: 2,2'-Dihydroxy-4,4'-dimethoxybenzophenone.

UVA III: 2-(2'-Hydroxy-4'-methoxyphenyl)-4,6-diphenyl-s-triazine.

UVA IV: 2-(2'-Hydroxy-4'-ethoxyphenyl)-4,6-diphenyl-s-triazine.

UVA V: 2-(2'-Hydroxy-4'-isopropoxyphenyl)-4,6-diphenyl-s-triazine.

UVA VI: 2-(2'-Hydroxy-4'-n-propoxyphenyl)-4,6-diphenyl-s-triazine.

Dyeing is carried out in bombs at a liquor ratio of 1:10, by first treating the pieces of tricot at 50° C. for 5 minutes and then raising the temperature, first to 100° C. in 10 minutes and then to 130° C. in a further 10 minutes. Dyeing is carried out at this temperature for 30 minutes and the goods are then cooled to 50° C., rinsed in warm water, centrifuged and dried at 80° C. in a circulating air oven. Finally, the 13 series of groups of 3 pieces of 10 g each are divided into 3 series. Whereas series 1 remains untreated, series 2 and 3 are treated in a hot air thermofixing device (for example the device made by W. Mathis, Niederhasli, Switzerland), series 2 for 60 seconds at 180° C., and series 3 for 60 seconds at 200° C.

The fastness to light under hot conditions as specified in Ford EU BO 50-2 of all the 39 samples is then tested (Test instructions FLT EU BO 50-2; test instrument Xenotest 1200, synchronized; duration of test 48 hours; black panel temperature 75° C.; humidity 80%). The following results are obtained.

TABLE I

| UV-Absorber | Amount % | FORD light-fastness values — | 180° C./60 seconds | 200° C./60 seconds |
|---|---|---|---|---|
| none | — | 1-2 | 1-2 | 1-2 |
| I | 1.65 | 3-4 | 3-4 | 2-3 |
| | 5.0 | −4 | 3-4 | 3 |

TABLE I-continued

| UV-Absorber | Amount % | FORD light-fastness values — | 180° C./60 seconds | 200° C./60 seconds |
|---|---|---|---|---|
| II | 1.65 | 3-4 | 3-4 | 3 |
| | 5.0 | 4 | 3-4 | 3+ |
| III | 1.65 | 3-4+ | 3-4+ | 3-4+ |
| | 5.0 | 4 | 4 | 4 |
| IV | 1.65 | −3-4 | −3-4 | −3-4 |
| | 5.0 | +3-4 | −4 | −4 |
| V | 1.65 | 3-4 | 3-4 | 3-4 |
| | 5.0 | 4 | 4 | 4 |
| VI | 1.65 | 3-4 | +3-4 | −4 |
| | 5.0 | −4 | +4 | +4 |

The assessment of light-fastness shows clearly that a marked decrease in the values takes place in the case of the two known UV absorbers I and II when thermofixing is carried out at 200° C. In the case of the UV absorbers which can be used in accordance with the invention the light-fastness value under hot conditions remains substantially constant.

EXAMPLE 3

The procedure is as described in Example 2, with the exception that no dye is employed. Thermofixing is carried out under the same conditions. The amounts of UV absorber present on the fibre are determined by diffuse reflection measurements on the pieces of tricot; the K/S values are quoted as a characteristic concentration value.

TABLE II

| UV-Absorber | Amount % | KS - VALUES (in %) — | 180° C./60 seconds | 200° C./60 seconds |
|---|---|---|---|---|
| I* | 1.65 | 25.1 (100%) | 19.0 (75%) | 11.3 (45%) |
| | 5.0 | 57.1 (100%) | 43.2 (75.7%) | 28.7 (50.3%) |
| II** | 1.65 | 26.1 (100%) | 21.5 (82.4%) | 18.0 (68.9%) |
| | 5.0 | 46.6 (100%) | 31.9 (68.5%) | 25.0 (53.6%) |
| III | 1.65 | 25.3 (100%) | 23.0 (90.9%) | 23.4 (92.5%) |
| | 5.0 | 48.5 (100%) | 39.6 (81.7%) | 29.9 (61.6%) |
| IV | 1.65 | 27.3 (100%) | 27.6 (100%) | 24.9 (91%) |
| | 5.0 | 43.2 (100%) | 41.0 (95%) | 40.9 (95%) |
| V | 1.65 | 22.6 (100%) | 21.8 (96%) | 20.7 (92%) |
| | 5.0 | 74.6 (100%) | 74.1 (99%) | 52.0 (70%) |
| VI | 1.65 | 23.6 (100%) | 24.7 (100%) | 26.0 (100%) |
| | 5.0 | 71.8 (100%) | 71.0 (99%) | 72.0 (100%) |

*slight yellowing caused by the product
**moderate yellowing caused by the product The K/S values show clearly that the loss of UV absorber by sublimation during thermofixing is definitely higher in the case of products I and II than in the case of products III—VI.

EXAMPLE 4

Beige dyeings are prepared on 5 series of ®Diolen tricot pieces, in each case 3 pieces of 10 g each, using the following combination of dyes (calculated in % by weight on the material to be dyed)

0.12% of C.I. Disperse Yellow 23
0.11% of C.I. Disperse Red 302
0.05% of C.I. Disperse Violet 57
0.02% of C.I. Disperse Blue 60 with the addition of 0.00, 1.65 and 5.0% of UV absorbers I and III. The preparation of the dyebaths and the procedure are as indicated in Example 1. The finished dyeings are also thermofixed and tested for fastness to light under hot conditions as indicated in Example 2. The following results are obtained.

TABLE III

| UV-Absorber* | Amount % | FORD light-fastness values — | 180° C./60 seconds | 200° C./60 seconds |
|---|---|---|---|---|
| none | — | −2–3 RH | 2–3 RH+ | 2–3 RH+ |
| I | 1.65 | 3 RH+ | 3 RH+ | 3 RH+ |
| | 5.0 | 3–4 RH | 3–4 RH | 3–4 RH |
| III | 1.65 | 4 | 4 | 4 |
| | 5.0 | 4 | 4 | 4 |

*in each case 20% of active substance

The values obtained in assessing fastness to light clearly show better assessments for UV absorber III.

EXAMPLE 5

Claret dyeings are prepared as described in Example 4 on 5 series of ®Diolen tricot pieces, in each case 3 pieces of 10 g each, and are thermofixed and tested. The dye preparation consists of:

| |
|---|
| 0.05% of C.I. Disperse Violet 57<br>0.05% of C.I. Disperse Blue 60<br>1.00% of C.I. Disperse Violet 95<br>0.40% of C.I. Disperse Orange 149 |

Assessment of fastness to light gave the following figures.

TABLE IV

| UV-Absorber | Amount % | FORD light-fastness values — | 180° C./60 seconds | 200° C./60 seconds |
|---|---|---|---|---|
| none | — | 3–4 | 3–4 GH | 3–4 GH |
| I | 1.65 | 3–4 GH+ | 3–4 GH | −4 |
| | 5.0 | −4 | −4 | 4 |
| III | 1.65 | 4 | 4+ | 4 |
| | 5.0 | 4–5 | 4–5 | 4–5 |

*in each case 20% of active substance

For these dyeings too, UV absorber III exhibits better results.

EXAMPLE 6

Grey dyeings are produced, with and without UV absorbers, on 7 10 g hanks of a Terylene ® staple yarn. Dyeing is carried out as described in Example 2, using the following dye preparation:

| |
|---|
| 1.0% of C.I. Disperse Yellow 42<br>0.3% of C.I. Disperse Blue 60<br>0.15% of C.I. Disperse Violet 5<br>0.40% of C.I. Disperse Red 302 |

The products I, III and VI are used as UV absorbers (cf. Table V). Light-fastness values were determined as specified in Ford EU BO 50-2 (48 hours and 96 hours) and DIN 75.202, draft (Fakra; 96 hours and 192 hours).

The following results are achieved.

TABLE V

| UV-Absorber | Amount % | Light-fastness values under hot conditions: FAKRA 96 hours | FAKRA 192 hours | FORD 48 hours | FORD 96 hours |
|---|---|---|---|---|---|
| none | — | 3–4 | 3 | 3–4 | 3 |
| I* | 1.5 | 3–4 | 3–4 | 3–4 | 3 |
| | 4.5 | 4–5 | 4 | +4 | 3–4 |

TABLE V-continued

| UV-Absorber | Amount % | Light-fastness values under hot conditions: FAKRA 96 hours | FAKRA 192 hours | FORD 48 hours | FORD 96 hours |
|---|---|---|---|---|---|
| III* | 1.5 | 4–5 | +4 | 4 | 3–4 |
| | 4.5 | 4–5 | +4 | +4 | 4 |
| VI* | 1.5 | −4–5 | −4 | 4 | 3–4 |
| | 4.5 | +4 | +4 | 4 | −4 |

*as 20% dispersions

It can be seen from the results of assessing light-fastness, that UV absorbers III and VI give better figures than UV absorber I in longterm tests.

What we claim is:

1. A process for improving the photochemical stability of dyeings on polyester fibre materials by means of UV absorbers, which comprises treating the fibre material with a compound of the formula

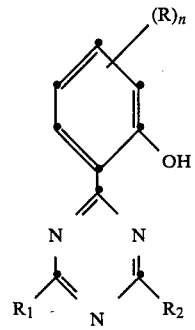

(1)

in which R is lower alkyl, lower alkoxy, halogen or hydroxyl, $R_1$ and $R_2$ independently of one another are alkyl, alkyl which is substituted by hydroxyl, lower alkoxy, lower alkylthio, amino, monoalkylamino or dialkylamino, phenyl, phenyl which is substituted by chlorine, lower alkyl or lower alkoxy, or o-hydroxyphenyl, and n is 0, 1 or 2.

2. A process according to claim 1, wherein a compound of the formula

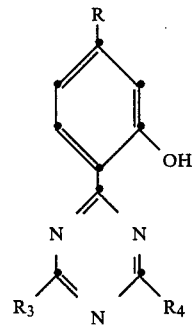

(2)

in which R is as defined in claim 1 and $R_3$ and $R_4$ independently of one another are alkyl having 1 to 4 C atoms, phenyl or phenyl which is substituted by lower alkyl or lower alkoxy, is used.

3. A process according to claim 1, wherein a compound of the formula

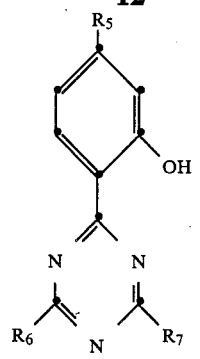

(3)

in which $R_5$ is lower alkyl or lower alkoxy and $R_6$ and $R_7$ independently of one another are alkyl having 1 to 4 C atoms or phenyl, is used.

4. A process according to claim 1, wherein the compound to be employed of the formula (1) is used in an amount of 0.5 to 7.5% by weight of the fibre material.

5. A process according to claim 1, wherein the compound of the formula (1) is added directly to the dyebath.

6. The polyester fibre material treated by the process according to claim 1.

* * * * *